US005904473A

United States Patent [19]

Dahmlos et al.

[11] Patent Number: 5,904,473

[45] Date of Patent: May 18, 1999

[54] VACUUM PUMP

[75] Inventors: Christian Dahmlos, Kremperheide; Dietmar Rook, Lägerdorf; Ralf Steffens, Lohbarbek, all of Germany

[73] Assignee: SIHI Industry Consult GmbH, Itzehoe, Germany

[21] Appl. No.: 08/973,884

[22] PCT Filed: Jun. 18, 1996

[86] PCT No.: PCT/EP96/02630

§ 371 Date: Dec. 17, 1997

§ 102(e) Date: Dec. 17, 1997

[87] PCT Pub. No.: WO97/01037

PCT Pub. Date: Jan. 9, 1997

[30] Foreign Application Priority Data

Jun. 21, 1995 [DE] Germany ..... 195 22 555
Jun. 21, 1995 [DE] Germany ..... 195 22 560

[51] Int. Cl.[6] ..... F04B 17/00

[52] U.S. Cl. ..... 417/410.4; 417/360; 417/418; 418/70; 418/206

[58] Field of Search ..... 417/410.4, 360, 417/418; 418/70, 206

[56] References Cited

U.S. PATENT DOCUMENTS 4,293,290 10/1981 Swanson ..... 418/94
4,621,994 11/1986 Ellis ..... 418/206
4,846,641 7/1989 Pieters et al. ..... 418/70
5,295,798 3/1994 Maruyama et al. ..... 418/201.1
5,314,312 5/1994 Ikemoto et al. ..... 417/16
5,329,216 7/1994 Hasegawa et al. ..... 318/654
5,354,179 10/1994 Maruyama et al. ..... 417/42
5,779,453 7/1998 Nagayama et al. ..... 417/410.4

FOREIGN PATENT DOCUMENTS 0 472 933 A2 3/1992 European Pat. Off. ..... F04C 29/00
0 558 921 A1 9/1993 European Pat. Off. ..... F04C 15/04

*Primary Examiner*—Charles G. Freay
*Assistant Examiner*—Paul L. Ratcliffe
*Attorney, Agent, or Firm*—Alix, Yale & Ristas, LLP

[57] ABSTRACT

A vacuum pump contains two rotary displacement rotor (8) that engage each other, in particular in a convoluted manner, inside in expansion chamber through which flows a stream in the axial direction. The rotors are mounted in cantilever at the delivery side and are linked each to a driving motor (35, 36). Each rotor (8) forms together with its shaft (20), a stationary bearing body (7) and a bearing (21, 22) delimited by the shaft (20) and the bearing body (7) a module that may be removed as a single unit from the housing (3). The rotor (35) of the driving motor is preferably also part of said module.

9 Claims, 4 Drawing Sheets

VACUUM PUMP

This is the national phase of International Application No. PCT/EP96/02630, filed on Jun. 18, 1996.

The invention relates to a vacuum pump having a pair of displacement rotors which rotate inside an axial-flow pump chamber and intermesh in particular in a helical manner. Each rotor is carried by one shaft and associated bearing, mounted on the pressure side, of which each shaft is connected to the armature of a motor arranged outside the housing forming the pump chamber.

This type of construction has the advantage that all members concerning the bearing arrangement and the drive of the rotors are arranged on the pressure side and gas emissions originating from them cannot pass so easily to the suction side of the pump. Expensive seals consequently become unnecessary. However, known pumps of this type (EP-A 472933=U.S. Pat. No. 5,197,861 and U.S. Pat. No. 5,354,179; EP-A 558921=U.S. Pat. Nos. 5,393,201; 5,295,798; 5,314,312; 5,329,216; JP-Abstract 2283890) have the disadvantage that the rotating parts are of difficult access and cannot easily be maintained because their assembly or dismantling presupposes that they, or a plurality of housing parts accommodating the bearing arrangement, are separated from one another. Since the rotating parts and their bearing arrangement are adjustment-sensitive, specially qualified personnel are required for this, who as a rule are only available to the manufacturer of the pump.

The invention avoids these disadvantages owing to the fact that each rotor, with the associated shaft and a stationary bearing body which can be fixed to the housing and accommodates the entire shaft bearing arrangement, forms a unit which is removable from the housing. The operationally sensitive bearing functions are concentrated in this construction unit. However, there may be applications in which a common bearing body can be provided for both rotors.

The housing forming the pump chamber is expediently defined on the pressure side by a base plate, in or to which the bearing body can be centred and/or fixed. This base plate may be connected in one piece to the pump-chamber housing. However, it is expediently a separate part. It may also be part of the motor housing, which as a rule is arranged on the base plate on the side remote from the pump-chamber housing.

As known from the prior art mentioned at the beginning, it is expedient if at least one rotor bearing is arranged inside the rotor in a space, open only towards the pressure side, on a tubular part, projecting into the rotor, of the bearing body. This ensures that the rotor shaft is subjected to only small bending stresses and that consequently the deformation-induced changes in the clearance of one rotor relative to the other as well as between the rotors and the housing can be kept small. This also permits favourable dimensioning of the rotor shaft, as a result of which the radial space requirement associated with the rotor internal bearing arrangement is partly compensated for.

It is known to provide the rotor shafts with interacting gear wheels which bring about the synchronization of the shafts or permit an emergency synchronization in addition to electronic synchronization. So that these gear wheels are not contaminated due to direct contact with the delivery medium and so that they can be lubricated if need be without the lubricant passing into the pump chamber, they are arranged according to the invention on the motor side of a flange plate, which for this purpose defines a space sealed off from the pump chamber and belongs to the construction unit removable with the rotor. Instead of the gear wheels, the synchronization means may also be pulse generator discs or the gear wheels serve simultaneously as pulse generator discs.

The flange plate is expediently sealed off from the pump chamber by the flange plate being sealed off from the base plate or the motor housing, while the base plate or the motor housing is sealed off from the pump-chamber housing. This enables the flange plate to be mounted and centred on the motor housing. The pump-chamber housing (or its shell and lid) can be removed for the maintenance of the pump chamber and the rotor surfaces without this impairing the tight closure of the spaces accommodating the synchronization discs.

The motor housing is expediently sealed off dust-tight from the atmosphere. Therefore the spaces accommodating the synchronization discs also do not need to be sealed off from the drive.

The motor armature also expediently belongs to the rotor unit removable in its entirety from the housing. The same applies to the synchronization gear wheel or the pulse generator disc, which is rotationally connected to the rotor construction unit and is part of a device for measuring the angle of rotation.

The invention enables the stockkeeping cost to be considerably reduced owing to the fact that pumps having different delivery data and belonging to the same series differ essentially only in the length of the rotors, the pump-chamber housing and if need be the tubular parts of the bearing bodies. Instead or in addition, they may also differ in the style of the displacement projections at the periphery of the rotors.

The invention is explained in more detail below with reference to the drawing, which illustrates an advantageous exemplary embodiment of the invention and in which.

Figure 1:
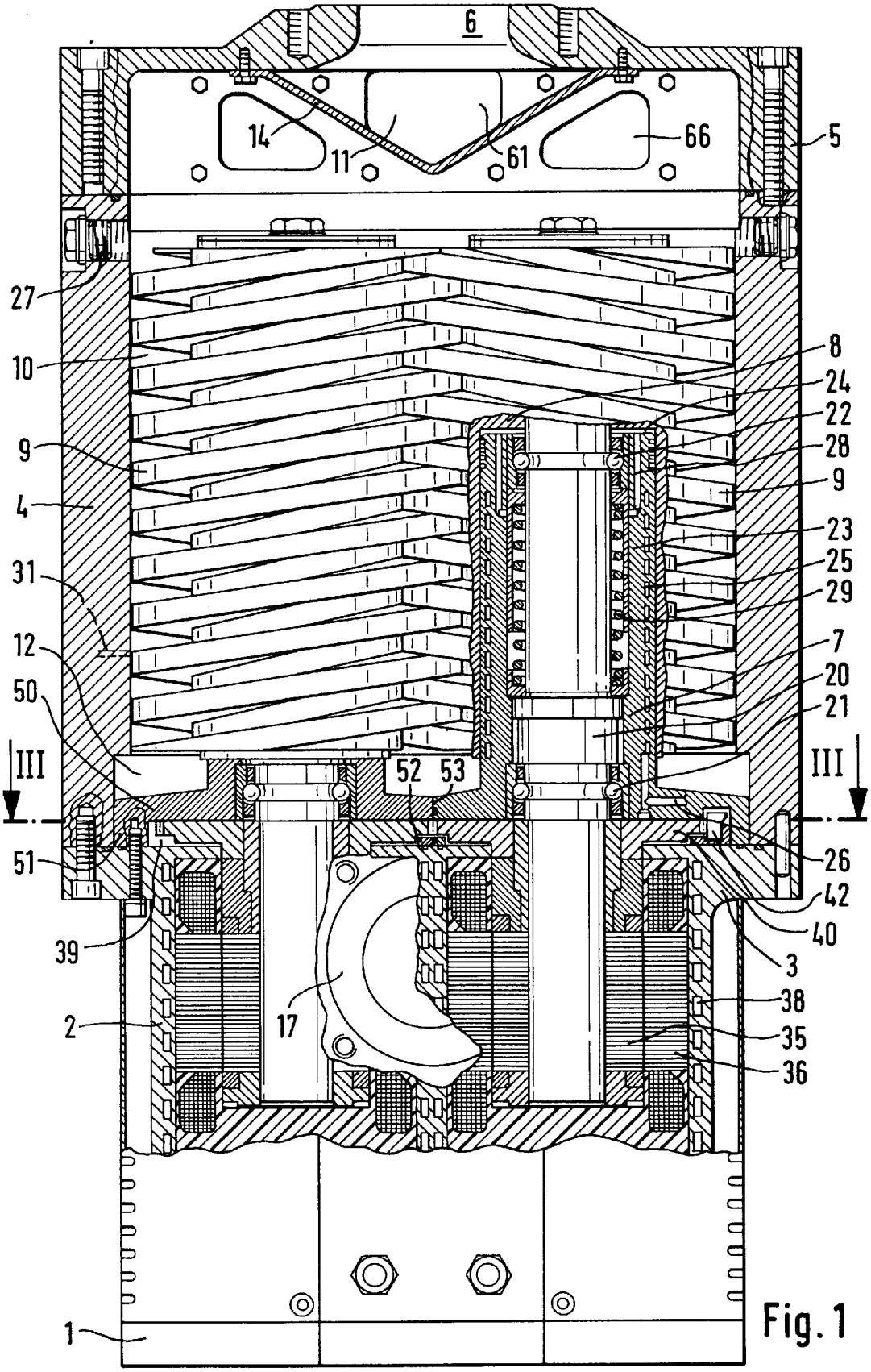
FIG. 1 shows a longitudinal section in the plane of both rotor axes.

Resting on the foot part 1 is the motor housing 2, which is connected, if need be in one piece, at the top to the flange-like base plate 3 on which the pump-chamber housing 4 is mounted. The latter is closed off at the top by a lid 5 which contains a suction opening 6.

Fastened to the base plate 3 in a manner to be explained later are the flange plates 50 of the bearing bodies 7, which in each case serve to carry a rotor 8, the periphery of which has displacement projections 9 which are preferably arranged as a two-start helix and engage like the meshing of teeth in the delivery hollow spaces 10 between the displacement projections 9 of the adjacent rotor. In addition, the displacement projections 9 interact at the periphery with the inner surface of the pump-chamber housing 4. The rotors 8 are connected at the top to the suction space 11 and at the bottom to the pressure space 12.

The pressure space 12 is connected by the passage 16 to the pressure outlet 17. These parts are provided at the bottom end of the vertically mounted pump-chamber housing.

Each rotor 8 is connected in a rotationally locked manner to a shaft 20 which is mounted at the bottom in the bearing body 7 by a permanently lubricated rolling bearing 21. A second, likewise permanently lubricated rolling bearing 22 is located at the top end of a tubular part 23 of the bearing body 7, which projects into a concentric bore 24 of the rotor 8, which bore 24 is open towards the bottom, i.e. on the pressure side. This bearing 22 is preferably located above the centre of the rotor 8. The tubular part 23 of the bearing body preferably extends through most of the length of the rotor 8. In a vertical arrangement of the pump, the end of the tubular part 23 lies substantially higher than the pressure outlet 17. This helps to protect the bearing and drive region from the ingress of liquid or other heavy impurities from the pump chamber.

Provided in the tubular part 23 of the bearing body are cooling passages 25 which are connected via passages 26 to a cooling-water source and via corresponding passages (not shown in the drawing) to a cooling-water discharge. The cooling passages 25 are preferably formed by helical turned recesses which are tightly covered by a sleeve. The cooling of the rotor bearings prolongs the service life or the maintenance intervals of these bearings. Furthermore, the peripheral surface of the tubular part 23 of the bearing body is also kept at a low temperature by the cooling. This peripheral surface is opposite the inner peripheral surface of the hollow space 24 of the rotor at a slight distance apart. These surfaces are designed in such a way that they are capable of good heat exchange and therefore heat can be dissipated from the rotor indirectly via the tubular part 23 of the bearing body and its cooling devices 25. The surfaces, opposite one another, of the tubular part 23 of the bearing body and the rotor hollow space 24 may be designed in a suitable manner in order to improve the heat exchange between them. For example, they may be treated or burnished in such a way that the radiation exchange is promoted by high absorption coefficients. The convective heat exchange by means of the gas layer in between may be improved by a small surface spacing and a suitable surface structure which leads to an increase in the coefficient of heat transmission. For this purpose, one surface or both surfaces may be designed with a coarse finish or with heat-exchange ribs or threads or the like. It is also possible to feed a sealing gas to the rotor hollow space 24 through the bearing body or the shaft 20, which sealing gas is discharged with the .delivery medium from the pressure space 12. Apart from the sealing of the bearing region, it can also serve to additionally cool the bearing, the bearing body and the rotor, but in this case it is expediently not directed through the bearing or bearings in order not to contaminate the latter but is directed via a passage 28 forming a bypass.

To protect the bearing and drive area from inflows penetrating from the pump chamber, suitable sealing and/or barrier devices are provided. It is especially advantageous to equip the opposite surfaces of the bearing body 23 and the inner surfaces of the rotor hollow space 24 with a delivery thread (not shown) on one side or both sides, which delivery thread exerts a delivery effect from the rotor hollow space 24 towards the pressure space 12. This delivery effect mainly acts on solid and liquid particles on account of their higher density and thereby prevents their ingress into the bearing and drive area. The delivery thread is expediently designed in such a way that this effect is still active even at a considerably reduced rotational speed.

The delivery effect can also be brought about by the gap between rotor and bearing body widening conically towards the pressure space. Here, the gap width (distance of the surface of the bearing body from the surface of the rotor) remains essentially constant. In addition, the surfaces opposite one another may also be provided in this case with a delivery thread on one side or both sides, but this is not necessary.

Since the equipping of the gap between rotor and bearing body with a delivery thread or conicity acting in a delivering manner provides a very effective seal against the ingress of liquid or solid particles, additional sealing devices may often be dispensed with; however, they may be provided, and in fact preferably in a non-contact or minimum-contact type of construction, e.g. labyrinth seals or piston-ring-like seals.

On account of the sealing action of the delivery thread or the gap conicity, the pump according to the invention is insensitive to the presence of liquid in the pump chamber as long as the rotors are rotating. This insensitivity also exists in the stationary state owing to the high bearing arrangement in the rotor as long as the liquid in the pump chamber does not reach the bearing level. It is not only important when the delivery medium carries a liquid surge with it but may also be utilized for cleaning and/or cooling the pump by liquid injection. For example, cleaning or cooling liquid can be injected through nozzles, of which one is indicated at 27. The same or separate nozzles 27 way be used for injecting the cleaning liquid and the cooling liquid.

If very severe contamination has to be expected, it is possible to inject cleaning liquid continuously during operation. During the operation of a vacuum pump, the cleaning liquid, provided it can pass into the pump chamber, should have a vapour pressure below the intake pressure. If the pump is a multi-stage pump and the contamination (for example as a function of pressure) nettles mainly in the second and/or following stages, it is possible to limit the injection of the cleaning liquid to the second or following stage and thereby to separate it from the auction side.

In most cases, however, the cleaning operation does not take place constantly but periodically if a requirement for cleaning (for example am a result of an increase in the drive torque) is established. Owing to the insensitivity of the pump to liquids, relatively large liquid quantities may then also be used. If the rotational operating speed cannot be maintained on account of the quantity or type of cleaning liquid used, the rotational speed may be reduced accordingly. Suitable control devices are provided for this. For example, the rotational speed may be controlled as a function of the drive torque, which, at increased power requirement, automatically leads to a corresponding reduction in the rotational speed relative to the rotational operating speed. The continuous rotation of the rotors even during the cleaning phase not only serves to seal the rotor bearing arrangement but also conveys the effect of the cleaning liquid to the contaminated surfaces.

The delivery action in the gap between rotor and bearing body may also be utilized to deliver sealing gas independently of an external compressed-gas source. However, to deliver the sealing gas, the action of such a compressed-gas source will generally be preferred in order to feed the sealing gas independently of the rotor speed.

The pump-chamber housing 4 may contain a pocket 30 (FIG. 2) which runs entirely around the periphery or over a large part thereof and through which cooling water circulates in order to keep the housing at a predetermined temperature. Cooling of the housing shell is not necessary in all cases. However, in the context according to the invention it is advantageously possible, since the rotors 8 are also cooled and their thermal expansion is therefore limited. It need not be feared that the rotors run against the housing only because they expand, while the housing is kept at a lower temperature.

The pump according to the invention may be provided with preadmission. This means that passages 31 are provided in the areas of higher, or possibly even average, compression in the housing, through which passages 31 gas of higher pressure than corresponds to the compression state in this area of the pump chamber is let into the pump chamber in order to effect cooling and/or noise reduction according to known principles. According to an advantageous feature of the invention, the preadmission gas can be extracted directly from the pressure side of the pump by being cooled in the cooling pockets 30 of the pump-chamber shell 4. For this purpose, it can be passed through heat-exchange tubes 32.

The rolling bearings 21, 22 in the example shown are angular-contact ball bearings which are set against one another by a spring 29. Each shaft 20 carries the armature 35 of the drive motor below the bearing 21, preferably directly, i.e. without an intermediate coupling, the stator 36 of the drive motor being arranged in the motor housing 2. The motor housing may be provided with cooling passages 38.

The flange plates 50, which in the example shown are made in one piece with the bearing bodies 7, are mounted with their outer margins 51, which essentially follow the periphery of the pump-chamber housing 4, and their abutting inner margins 52 on the top side of the base plate 3. The flange plates 50 are sealed relative to the base plate 3. The end faces 53, which follow a secant in radial section and at which the flange plates 50 bear against one another, are also provided with a sealing insert.

A turned recess is provided below the flange plates 50 between the margins 51, 52, which turned recess encloses with the top side of the base plate 3 a space 39 which serves to accommodate synchronization gear wheels 40 which are arranged in a rotationally locked manner with known means on the shafts 20 between the bearings 21 and the motor armatures. So that they can mesh with one another in the area of the inner margins 52 of the flange plates 50, the inner margins have a cut-out at an appropriate point, through which cut-out the gear wheels reach. Remaining below this cut-out on each side is a web to which the reference line of the reference numeral 52 generally designating the inner margin points in FIG. 1. This web is advantageous not only for stability reasons but also because it permits an encircling seal on the one hand relative to the base plate 3 and on the other hand between the flattened secant faces of the flange plates 50.

The turned-out portions 39 in the flange plates 50 have a diameter which is greater than the diameter of the sychronization gear wheels 40. They are arranged with slight eccentricity in relation to the inner margins 52 so that the sychronization gear wheels 40 can be inserted upon assembly of the rotor construction units despite the presence of the sealing web at 52.

Since the space 39 containing the synchronization gear wheels 40 is completely separate from the pump chamber, there is no risk of the synchronization gear wheels becoming contaminated. They are merely used for the emergency synchronization of the rotors. Their teeth normally do not come in contact with one another. Lubrication is therefore unnecessary as a rule. Although it may be used if desired, the dry running of the synchronization gear wheels simplifies the construction, since sealing between the space 39 and the drive motors is not necessary.

The sychronization gear wheels 40 may also serve as pulse generator discs or may be supplemented by additional pulse generator discs which are scanned by sensors 42, of which one is shown in FIG. 1. These sensors 42 are connected to a control device which monitors the respective rotary position of the rotors relative to a set point and corrects it via the drive. This concerns electronic synchronization of the rotors, which is known as such and therefore need not be explained in more detail here. The play between the teeth of the synchronization gear wheels 40 is slightly smaller than the flank clearance between the displacement projections 9 of the rotors 8. However, it is greater than the synchronization tolerance of the electronic sychronization device. During proper functioning of the latter, therefore, neither the flanks of the displacement bodies 9 nor the teeth of the synchronization gear wheels 40 come into contact with one another. In the event of the latter nonetheless coming in contact with one another, they are provided with a coating which is wear-resistant and, if need be, promotes sliding.

The performance data of the pump, apart from being determined by the drive output and rotational speed, are determined by the displacement or delivery volume formed at the rotors and thus by the length of the rotors. The delivery data may therefore be altered by altering the length of the pump part containing the rotors. A series of pumps having different performance data is therefore preferably distinguished by the fact that the individual pumps of this series differ through graduation of the length of these parts, to which the pump-chamber housing, the rotors and if need be the tubular parts, projecting into the rotors, of the bearing bodies belong.

It will be recognized that each rotor forms with the associated bearing and drive devices a construction unit which can be mounted independently and, apart from the rotor, consists of the bearings 21, 22, the bearing body 7, the cooling devices provided therein, the shaft 20, the synchronization gear wheel 40, the associated sensor 42 and the motor armature 35. These units are inserted into the pump in a completely preassembled manner. They can easily be removed from the base plate 3 or inserted after removal of the pump-chamber housing. The exchanging of these units can therefore be left to the user, whereas the manufacturer takes care of the maintenance of the sensitive units as such.

Figure 2:
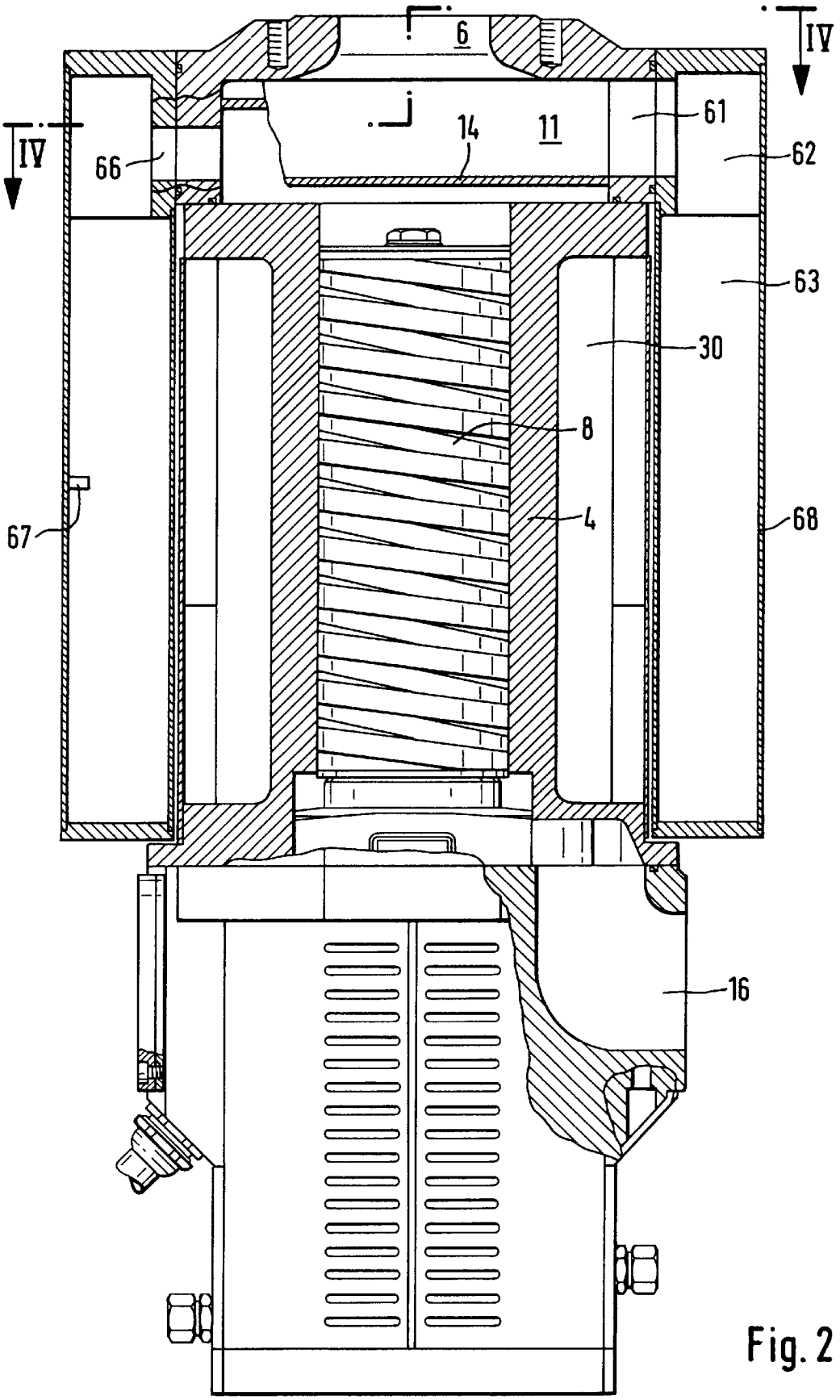
FIG. 2 shows a longitudinal section transversely thereto.
Figure 3:
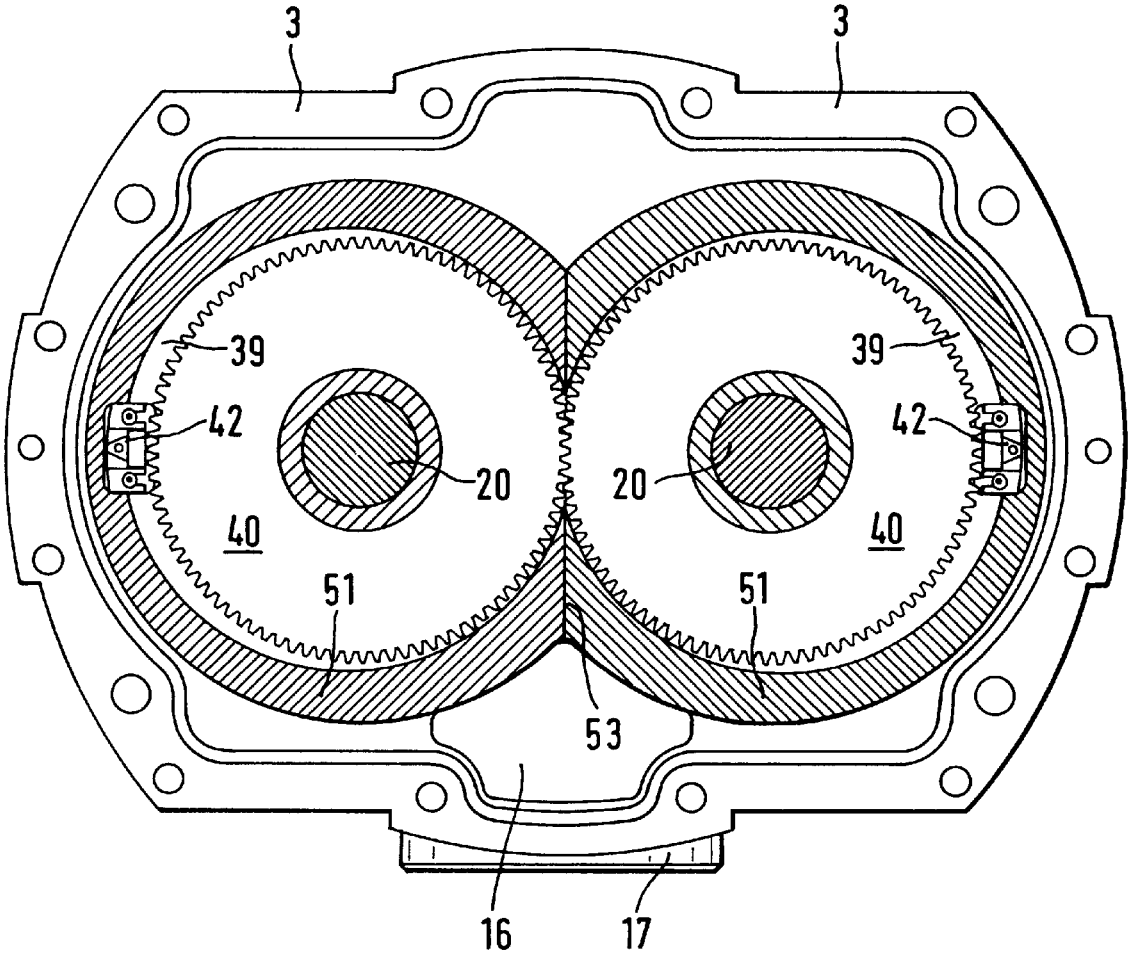
FIG. 3 shows a horizontal section along line III—III in FIG. 1.
Figure 4:
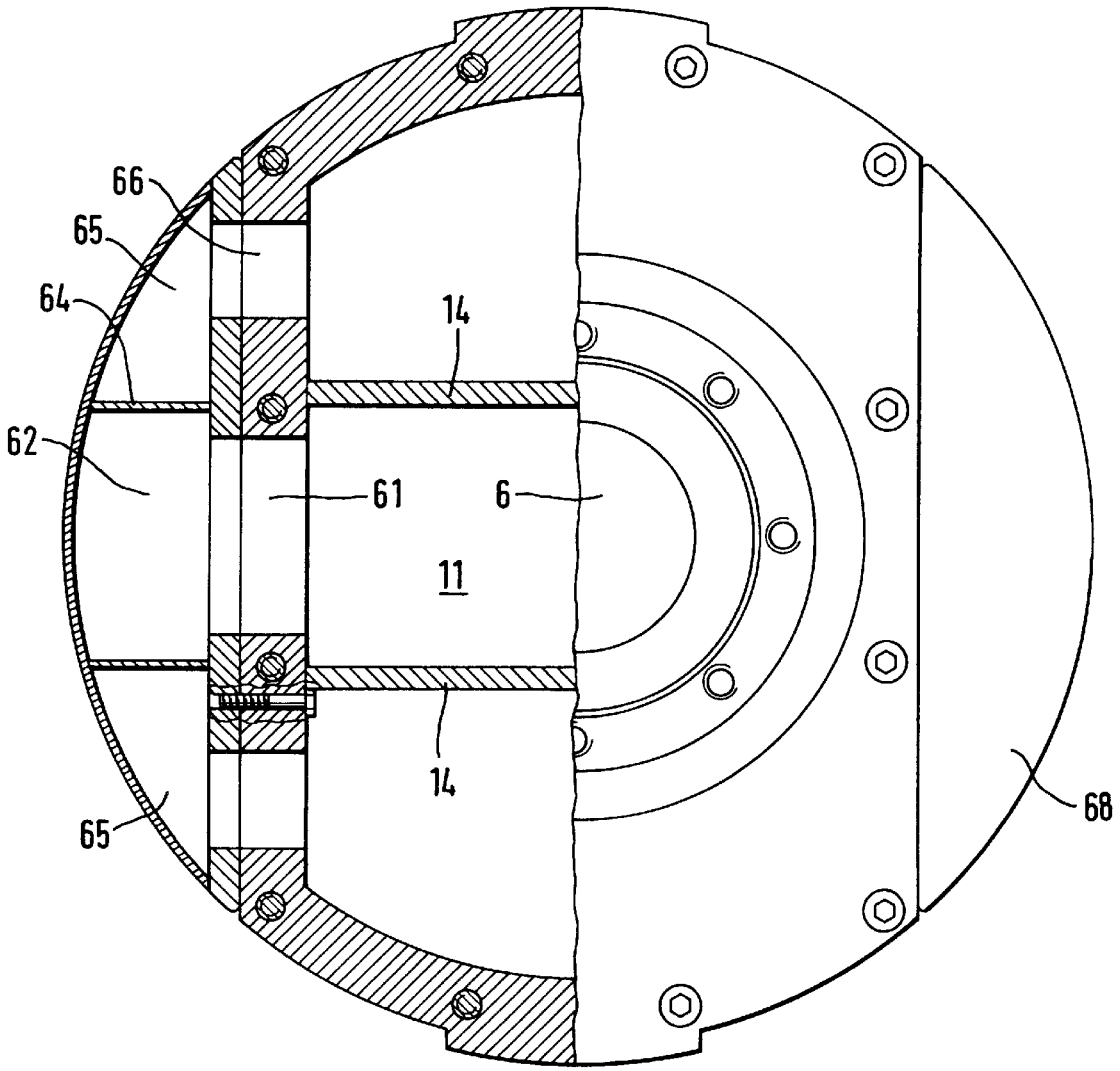
FIG. 4 shows a plan view partly sectioned along line IV in FIG. 2.

FIGS. 2 and 4 illustrate that the suction space 11 is separated from the pump chamber by a cover plate 14 which prevents direct passage of the drawn-in medium from the suction opening 6 into the pump chamber. Instead, it passes first of all through the one or the other of two openings 61 in the head space 62 of one of two settling spaces 63 which are placed as special containers 68 against the wide sides of the pump-chamber housing 4. The head space 62 is open downwards towards the settling space 63 and is defined laterally by partition walls 64 of two side spaces 65, which are likewise open towards the settling space 63 and are connected to the pump-chamber of the pump by one opening 66 each, which are arranged on either side of the opening 61. The drawn-in medium passes from the suction opening 6 through the suction space 11 into a centre head space 62, is deflected therein downwards into the settling space 63, is deflected therein upwards to one of the side head spaces 65 and passes from here through the opening 66 into the pump chamber. The openings 61, 62 through which the medium flows into the settling space 63 are therefore spatially offset from the openings 65, 66 through which it flows off again into the pump chamber. The deflection thereby imposed on the gas flow has the result that liquid or solid particles entrained by it for instance are thrown downwards into the settling space 63 on account of the inertiae action. This also applies in particular to any liquid surge. If a liquid surge has to be expected quite often, the settling spaces may be provided with discharging devices for the liquid contained therein. A level gauge 67 may be provided independently thereof or even if need be functionally connected thereto.

The pump is preferably of the isochoric type of construction so that larger liquid quantities can also be safely delivered.

We claim:

1. Vacuum pump having a housing forming an axial-flow pump chamber with a pressure side, a pair of displacement rotors mounted within the chamber on the pressure side to intermesh in a helical manner, each rotor being carried by a separate shaft (20) having a respective arranged outside the housing (4) which forms the pump chamber and having an armature connected to each shaft and a shaft bearing including a special stationary bearing body (7) fixed to the housing, each of said rotor, associated shaft and shaft bearing forming a unit which is removable from the housing.

2. Vacuum pump according to claim 1, characterized in that a separate bearing body (7) is allocated to each rotor (8).

3. Vacuum pump according to claim 1 including a base plate on the pressure side adjoining the housing (4) forming the pump chamber, to which base plate (3) the bearing body (7) can be fixed.

4. Vacuum pump according to claim 1 including a flange plate (50) which can be removed together with the rotor construction unit and defines a space which is sealed off from the pump chamber, a synchronization gear wheel (40) and/or a pulse generator disc being provided in the sealed off space.

5. Vacuum pump according to claim 3 including a motor housing (2) arranged on the base plate (3) on the side remote from the pump-chamber housing (4).

6. Vacuum pump according to claim 1, wherein at least one rotor includes a cavity open only towards the pressure side (12), the bearing body includes a tubular part (23), projecting into the cavity and a rotor bearing is arranged inside the rotor cavity.

7. Vacuum pump according to claim 1, wherein the motor armature (35) also is removable.

8. Vacuum pump according to claim 4, wherein the synchronization gear wheel or the pulse generator disc is removable in its entirety.

9. Series of vacuum pumps according to claim 1, characterized in that pumps have different delivery data, apart from the drive, and differ in the length of the rotors and the pump-chamber housing.

* * * * *

UNITED STATES PATENT AND TRADEMARK OFFICE

CERTIFICATE OF CORRECTION

PATENT NO. : 5,904,473

DATED : May 18, 1999

INVENTOR(S) : Dahmlos et al.

It is certified that error appears in the above-identified patent and that said Letters Patent is hereby corrected as shown below:

Claim 3, line 2, after "housing (4)" insert --which forms-- and delete "forming".

Signed and Sealed this

Tenth Day of October, 2000

*Attest:*

*Attesting Officer*

Q. TODD DICKINSON

*Director of Patents and Trademarks*